US005501454A

United States Patent [19]

Frantz

[11] Patent Number: 5,501,454

[45] Date of Patent: Mar. 26, 1996

[54] FOOTBALL KICKING TEE

[75] Inventor: Matthew H. Frantz, Cincinnati, Ohio

[73] Assignee: Frantz, Inc., Cincinnati, Ohio

[21] Appl. No.: 293,495

[22] Filed: Aug. 19, 1994

[51] Int. Cl.[6] ..... A63B 67/00

[52] U.S. Cl. ..... 273/55 B; 273/55 R; 273/202; 273/203

[58] Field of Search ..... 273/55 B, 33, 273/205, 206, 209, 211, 212

[56] References Cited

U.S. PATENT DOCUMENTS

| | | |
|---|---|---|
| D. 266,015 | 8/1982 | Patton . |
| D. 269,890 | 7/1983 | Stenerud . |
| D. 275,303 | 8/1984 | Box, Sr. . |
| D. 277,973 | 3/1985 | Stenerud . |
| D. 322,106 | 12/1991 | Rambacher . |
| D. 333,170 | 2/1993 | Patton . |
| D. 333,500 | 2/1993 | Berger et al. . |
| D. 338,250 | 8/1993 | Tvedt . |
| 3,309,087 | 7/1964 | Cullity . |
| 3,762,706 | 10/1973 | Cavett . |
| 4,019,735 | 4/1977 | Thompson . |
| 4,261,564 | 4/1981 | Holahan et al. . |
| 4,418,910 | 12/1983 | Stenerud . |
| 4,460,173 | 7/1984 | Dumas . |
| 4,477,077 | 10/1984 | Ferrebee . |
| 4,511,141 | 4/1985 | Dumas . |
| 4,537,397 | 8/1985 | Kopp . |
| 4,546,974 | 10/1985 | Brown . |
| 4,632,395 | 12/1986 | Ferrebee . |
| 4,634,122 | 1/1987 | Kline . |
| 4,641,834 | 2/1987 | Hegedus et al. . |
| 4,648,596 | 3/1987 | Long . |
| 4,655,453 | 4/1987 | Spiegel et al. . |
| 4,657,252 | 4/1987 | Spiegel ..... 273/55 B |
| 4,749,184 | 6/1988 | Tobin . |
| 4,865,330 | 9/1989 | D'Amico . |
| 4,946,165 | 8/1990 | Rambacher . |
| 4,949,973 | 8/1990 | Williamson . |
| 4,991,840 | 2/1991 | Patton . |
| 5,078,395 | 1/1992 | Thorne . |
| 5,280,922 | 1/1994 | Jones . |

FOREIGN PATENT DOCUMENTS

| | | | |
|---|---|---|---|
| 2233907 | 1/1991 | United Kingdom | 273/55 B |

*Primary Examiner*—Vincent Millin
*Assistant Examiner*—Charles W. Anderson
*Attorney, Agent, or Firm*—Dinsmore & Shohl

[57] ABSTRACT

The present invention is directed to a football kicking tee having a ring extending in a segment of a circle for a perimeter distance of about between 180° to 360°. The ring has a first surface having a first frictionally enhanced finish for supporting a football, and also has a second surface having a second frictionally enhanced finish for engaging a substrate.

15 Claims, 2 Drawing Sheets

FOOTBALL KICKING TEE

TECHNICAL FIELD

The present invention relates generally to football kicking tees and more particularly to a kicking tee for holding a football in a wide range of substantially vertical or angled positions. The invention will be disclosed in connection with a multi-purpose kicking tee that is particularly useful in supporting a football in an optimal position for the practice of place kicking.

BACKGROUND OF THE INVENTION

Over the past several decades accurate place-kicking capabilities for kick-offs, scoring field goals, as well as scoring extra points has become an indispensable weapon in the arsenal of modern football teams. A football is typically positioned on a kick-off tee to perform the kick-off. The place kick for extra points and field goals is typically performed with a player called a holder assisting the kicker by teeing up the football in a stationary, substantially upright position with one end of the football resting on either the playing surface or a flat kicking plate commonly referred to as a tee. The football is hiked from the center to the holder who transfers it into the teed up position before the kicker's foot engages the football. The holder normally steadies the football in the desired substantially upright position by placing a finger on the upper tip end of the football and applying slight pressure downwardly on the football.

High proficiency and accurate place-kicking is obtained by hours and hours of practice out of season, as well as during the season. To most nearly simulate actual game conditions, the participation of a holder is required at practice sessions to support the football in the desired vertical or angled position used for placekicking. However, it is impractical to dedicate the services of a player solely to serve as the practice holder for a placekicker. Additionally, in practicing during the off season, it is difficult for placekickers to obtain the assistance of other persons to hold footballs in the desired position while the kicker practices.

In an attempt to aid placekickers in practicing their kicking skills, a variety of devices have been employed in the past as a substitute for the human holder. One prior art device for holding a football in a substantially vertical position includes a structure having an arm which is indefinitely variable for allowing a mechanical finger on the arm to be pre-set to engage one end of the football and impose a compressive force downwardly against the football. This device allows for footballs of various sizes to be held at various limited angles relative to the ground or kicking tee. Although these devices act as a holder for practicing placekicking footballs, these devices tend to be expensive, heavy and cumbersome. Furthermore, significant time is required to reposition the mechanical finger to place sufficient compression on the top end of the football to hold it in the desired position. Illustrative examples of this type of device are shown in U.S. Pat. Nos. 4,546,974 to Brown and 4,634,122 to Kline.

Another alternative for practicing placekicking without a human holder is to use a kick-off tee, such as the types described in U.S. Pat. Nos. 3,309,087 and 4,418,910. With these types of devices, a ball is supported on a platform having three legs that support a platform at a desired height above the surface. The tee platform also has upright elements to engage the sides of the football and hold it in a substantially upright position.

However, there are many shortcomings using kick off tees to practice placekicking for field goals and extra points. Currently, NFL and collegiate rules require that the bottom end of the football touch the playing surface when kicking field goals and extra points. These above-mentioned kicking tees elevate the football above the playing surface and do not simulate place-kicking under game conditions. Further, the upright elements used on these prior art kick-off tees for engaging the sides of football interfere with the kicking motion. Repeated kicking of a football from these types of kicking tees can bruise the instep of a soccer-style kicker's foot since there is relatively little tissue between the skin and bone.

None of the current devices provide a simple device allowing a placekicker to practice kicking footballs by himself simulating game conditions (i.e. placekicking with a football positioned with one end touching the playing surface, or in the alternative, placing the practice device on a block so that a kicker can practice placekicking with the one end of the football elevated above the playing surface). As such, none of the prior art kicking tees are fully satisfactory for practicing placekicking.

SUMMARY OF THE INVENTION

Accordingly, it is an object of the present invention to provide a kicking tee that supports a football in a substantially upright position at various angles to replicate the position of the football during game conditions.

It is still a further object of the present invention to provide a football kicking tee that can be used by all type of kickers, namely straight-on or soccer-style kickers, and left looted or right footed kickers, at any competition level (high school, collegiate, or professional).

It is another object of the present invention to provide a football kicking tee that does not substantially interfere with the surface of the football to be kicked.

Furthermore, it is another object of the present invention to provide a football kicking tee that is inexpensive, and easy to set-up and use when practicing.

Furthermore, it is another object of the present invention to provide a football kicking tee that can be used in practice to most closely simulate game conditions for all placekicking duties, including field goals, extra points and kick-offs without affecting distance or accuracy.

It is an object of the present invention to provide a kicking tee that can be used on any playing surface (i.e., natural or artificial turf), or on a placekicking block.

It is a further object of the present invention to provide a football kicking tee that provides little resistance or interference to the football being kicked off the tee.

It is still another object of the present invention to provide a football kicking tee capable of supporting a football at variable angles above the ground.

It is still another object of the present invention to provide a football kicking tee that is inexpensive and easy to manufacture.

It is still a further object of the present invention to provide a football kicking tee for practice that is stable, yet is also light weight, and easily moved and assembled for use.

Additional objects, advantages, and other features of the present invention will be set forth and will become apparent through the description that follows, and in part, will be apparent to those skilled in the art upon examination of the following, or may be learned with practice of the present invention. The objects and variants of the present invention may be realized and obtained by means of the instrumentalities and combinations particularly pointed out in the appended claims.

To achieve the foregoing and other objects, and in accordance with the purpose herein, the present invention is directed to a football tee having a support member, such as a ring, whereby the ring extends in a segment of a circle for perimeter distance of about between 180°. The ring has a first surface having a first frictionally enhanced finish for supporting a football, and also has a second surface having a second frictionally enhanced finish for engaging the ground or a substrate.

In one embodiment, the first frictionally enhanced finish may be provided by scoring the area extending around the first surface which aid in supporting a football in a substantially vertical position. The second frictionally enhanced finish may be formed by a plurality of raised projections extending around the second surface for engaging the substrate by increasing the frictional engagement between the substrate and the second surface.

In another embodiment, the football kicking tee also has extensions attached to the second surface for elevating the ring horizontally above the substrate.

According to another aspect of the invention, a method of supporting a football in a pre-determined position is directed to providing a football kicking tee with an opening formed by the inner diameter of a ring extending in a segment of a circle for a perimeter distance of about 180° to 360°. One end of a football is positioned in the opening and the football's side portion is engaged against the inner diameter of the ring, which supports the football in a substantially upright or angled position by frictional engagement between the side portion of the football and the inner diameter of the ring.

BRIEF DESCRIPTION OF THE DRAWINGS

The drawings, incorporated in and forming a part of the specification, illustrate several aspects of the present invention, and together with the description, serve to explain the principles of the invention. In the drawings.

Figure 1:
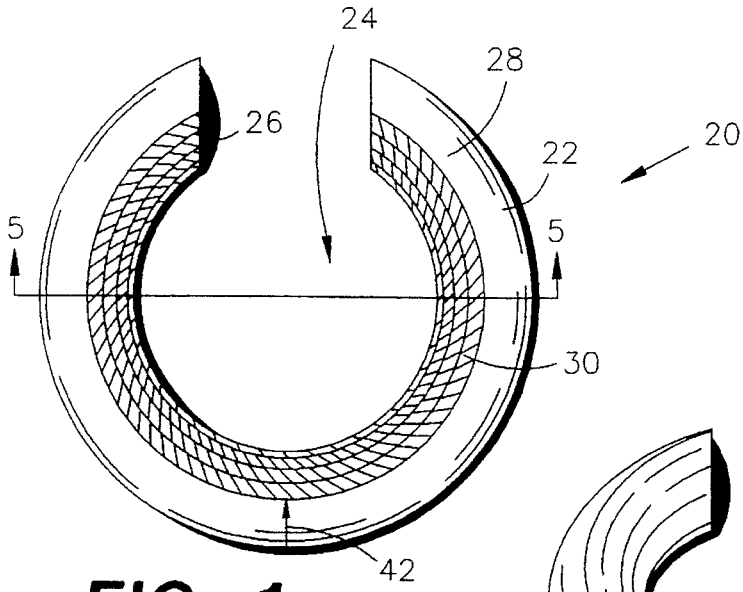
FIG. 1 is a top plan view of a kicking tee constructed in accordance with the principles of the present invention.
Figure 4:
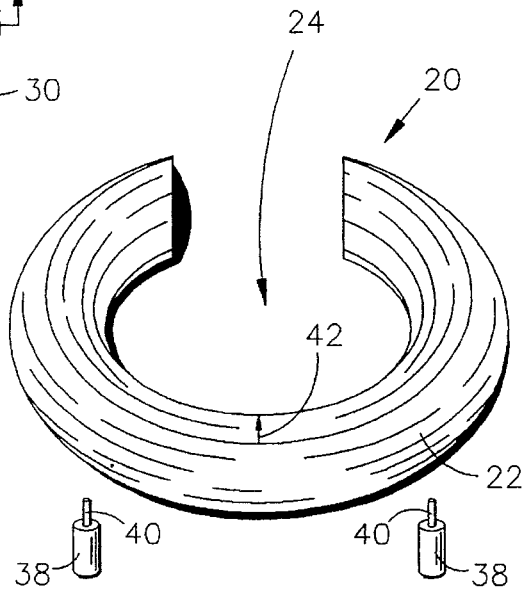
FIG. 4 is an exploded perspective view of another embodiment of the present invention.
Figure 4:
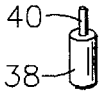

Reference will now be made in detail to the present preferred embodiment, examples of which are illustrated by the attached drawings.

DETAILED DESCRIPTION OF THE PREFERRED EMBODIMENT

Referring now to the drawings in which identical or similar parts are designated by the same reference number throughout, a kicking tee is generally designated by the numeral 20 is shown. The kicking tee 20 is adapted for use with any type of kicker, including a left or right footed kicker, or straight-on or soccer-style kicker. The kicking tee 20 includes a support member, specifically illustrated as a ring 22. As illustrated in FIGS. 1–10, the ring 22 can be circular in shape. In the embodiments shown in the drawings, the ring 22 extends in a segment of a circle where the perimeter distance is about between 180° and 360° and preferably, is about between 270° to 320°. The ring 22 of the preferred embodiment has an outside diameter about between 3.3" to 3.5", and an inside diameter of about between 2.05" to 2.15".

The ring 22 is configured to have an opening within, as shown by numeral 24 in FIGS. 1,2,4,6,7 and 9. This opening 24 is defined by the inner diameter of ring 22, and is sized to correspond to an end portion of a football, so that an end portion of a football can be inserted therein and held in a substantially vertical position without assistance from a human holder or other device. Consistent with this purpose, the opening 24 is of insufficient size to allow complete passage of a football.

Although the ring 22 can be used to support any size football, the most preferred form of the invention has a opening 24 that is sized to accommodate a regulation sized football. Current NFL and collegiate rules require that all placekicking (i.e. field goals and extra points) must be done with one end of the football touching the playing surface. Thus the inside diameter of the ring 22 preferably is sized and configured so that the lowest point of the football touches the kicking substrate. If the inner diameter is configured so that the lowest point of the football does not touch the "substrate," discussed in detail later, then kicking tee 20 would not comply with current NFL and collegiate rules, and thus would not simulate game conditions.

Figure 5:
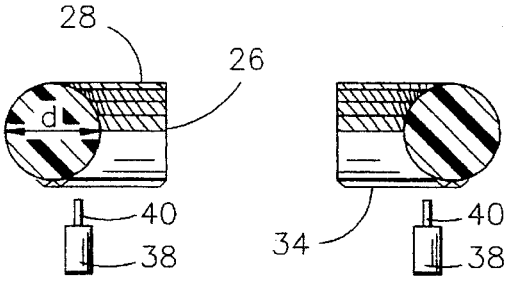
FIG. 5 is a longitudinal section view taken along line 5—5, as shown in FIG. 1.
Figure 3:
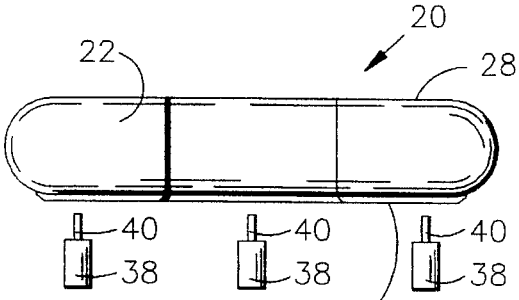
FIG. 3 is an exploded front elevational view of the kicking tee, as shown in FIG. 1, showing extensions that are optionally attached to the bottom of the tee.
Figure 10:
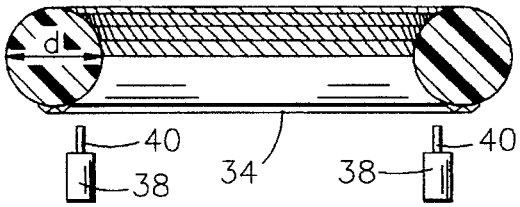
FIG. 10 is a longitudinal section view taken along line 10—10, as shown in FIG. 6.
Figure 8:
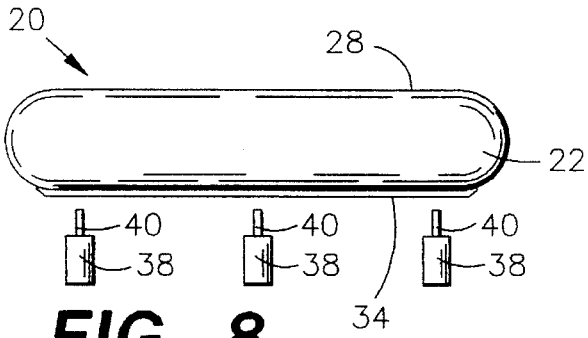
FIG. 8 is an exploded front elevation view of the kicking tee of FIG. 6 showing extensions that are optionally attached to the bottom of the tee.

The ring 22 preferably has a constant thickness around the perimeter distance and has a cross-sectional radius as illustrated by "d" in FIGS. 5 and 10 of about between 1.25" to 1.35" inches, so that ring 22 remains stable in use, which is discussed in further detail hereinafter.

Figure 6:
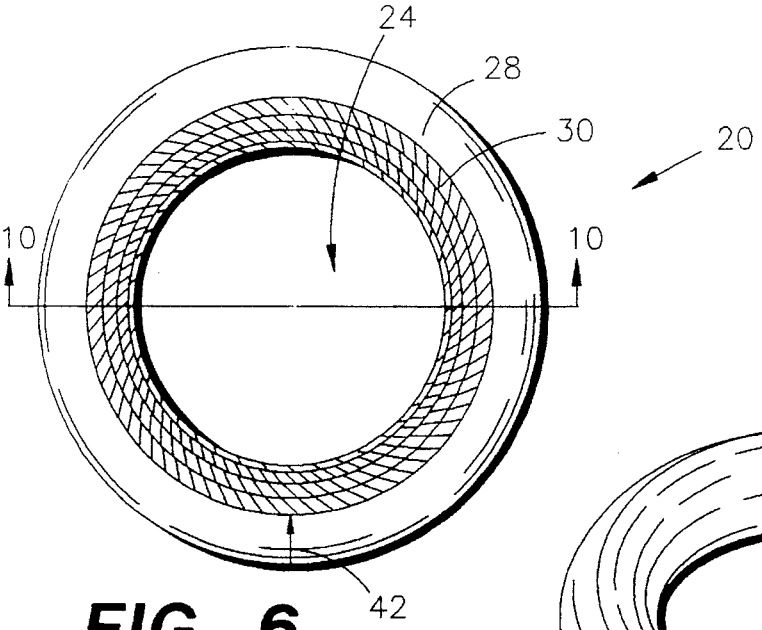
FIG. 6 is a top plan view of an alternative kicking tee constructed in accordance with the principles of the present invention.
Figure 9:
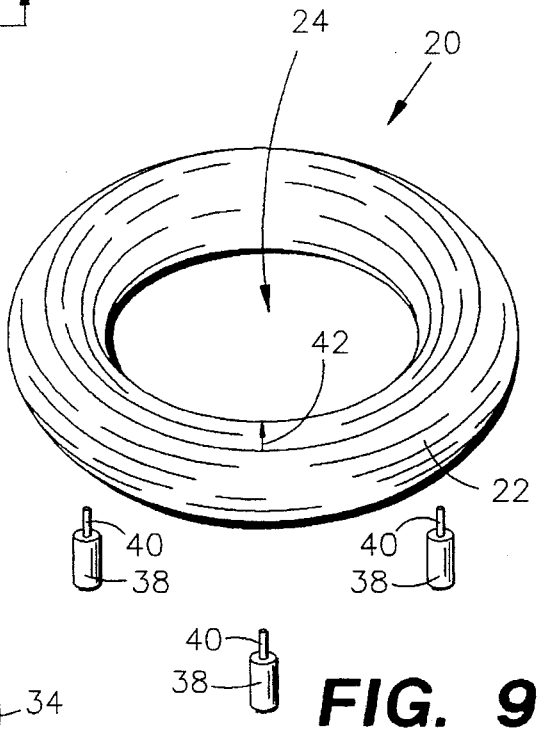
FIG. 9 is an exploded perspective view of the kicking tee of FIG. 6.

Referring to FIGS. 1 and 6, the ring 22 has a first surface 28 with a frictionally enhanced finish 30 for enhancing the coefficient of friction between the sides of opening 24. In the preferred embodiment, this frictionally enhanced finish 30 is formed by scoring, as shown in FIGS. 1, 5, 6, and 10, which aids in retaining a football in a desired position due to frictional engagement and also prevents slippage of the football when playing conditions are wet and first surface 28 is slippery. Other types of frictionally enhanced finishes can be used on first surface 28, as discussed below, so long as the lower end of the football touches the substrate. It should also be noted that a football can be supported in opening 24 at an angled position without first surface 28 having a frictionally enhanced finish 30.

Figure 2:
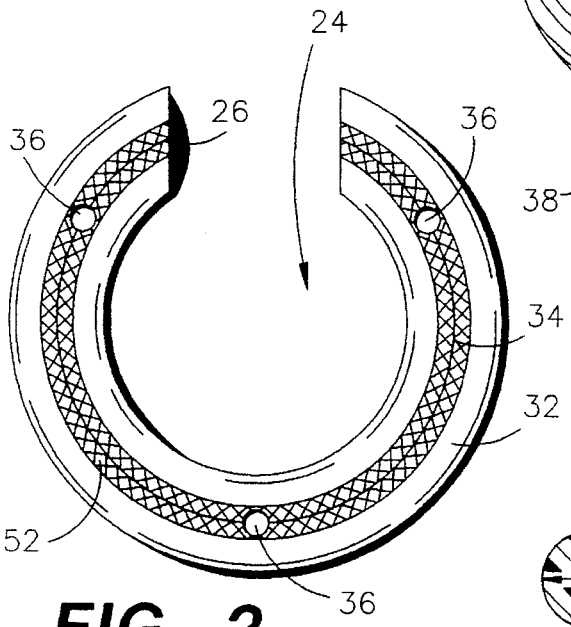
FIG. 2 is a bottom plan view of the kicking tee shown in FIG. 1.
Figure 7:
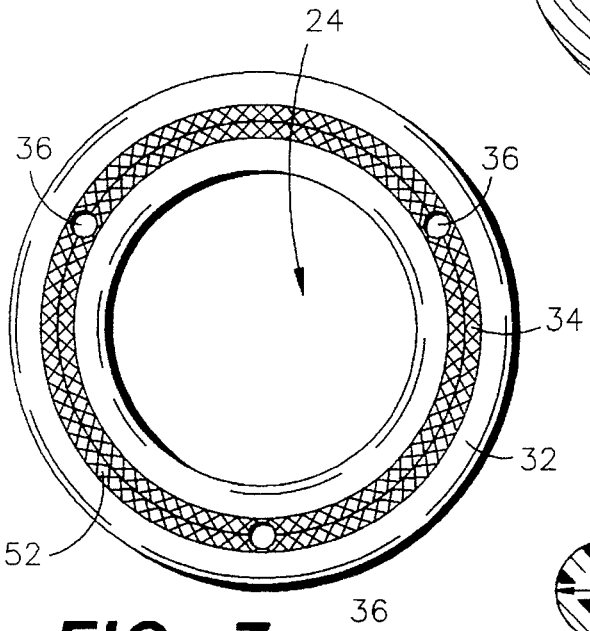
FIG. 7 is a bottom plan view of the kicking tee of FIG. 6.

The ring 22 also has a second surface 32 with second frictionally enhanced finish 34, as shown in FIGS. 2 and 7. Preferably, second frictionally enhanced finish 34 is a plurality of small raised projections 52 which extend around the surface of ring 22, and are engageable with surfaces, such as typical playing surfaces, (a natural grass surface or an artificial turf surface), the practice surface, which can be concrete, blacktop, mud, dirt, a gym floor, and the like, or a block kicking tee (collectively known as the "substrate"). Engaging the substrate with the frictionally enhanced finish 34 assists in retaining the kicking tee 20 in a fixed position, preventing the kicking tee 20 from tipping over or sliding, thus disrupting the kick when force is applied to kicking tee 20 via a kicker's foot. Second frictionally enhanced finish 34 frictionally engages the "substrate" to maintain the predetermined orientation and location of kicking tee 20 and to prevent movement of kicking tee 20.

As those skilled in the art will readily appreciate, the frictionally enhanced finishes 30 and 34 can be achieved by a variety of techniques, such as scoring, a plurality of parallel grooves, a plurality of raised, spaced cylinders presenting a textured face, or a toughened configuration, all of which provide enhanced frictional engagement of the football with first surface 28, or enhanced frictional engagement of the substrate with second surface 32.

As shown in FIGS. 1 through 5, the ring 22 preferably has a discontinuity portion of the perimeter distance which is denoted by 26. This discontinued portion 26 extends in a segment of a circle where perimeter distance is about between 0° and 180° . Preferably, the perimeter distance of discontinuity portion 26 is about between 90° to 40°, allowing for the end of the football to leave football kicking tee 20 without interference therefrom after being kicked.

The football kicking tee 20 also can comprise extensions 38, as shown in FIGS. 2,4,5,8,9 and 10, which elevate ring 22 above the "substrate". As shown in FIGS. 2 and 7 holes 36 are forged in second surface 32 to receive removable extensions 38. Removable extensions 38 have projections 40, shown in FIGS. 4 and 9, which can snap fit into engagement with holes 36 or screw into holes 36. Extensions 38 are sized to elevate the football kicking tee 20 to the desired distance above the "substrate", usually 1" to 2". In al alternative configuration, kicking tee 20 can be a one piece configuration including both ring 22 and extensions 38 extending from bottom surface 32.

The material of the football kicking tee 20 is substantially rigid, yet easily moldable so that it is inexpensive and easy to make, yet abrasion resistant for repeated rough use. Many types of materials can be used, including, but not limited to, a synthetic resin such as thermoplastic urethane vinylacetate (UVA), polyurethane, polyvinylchloride (PVC), nylar, natural rubber (SBR), synthetic rubber, ethylene propylene turpolymer, foamed polyurethane, reclaimed rubber (recycled tired and like), and high durometer rubber such as butyl rubber. Reclaimed rubber is cheap and easy to find. However, if one desires a kicking tee 20 in a color other than black, a material other than reclaimed rubber should be used.

The rigidity of kicking tee 20 should be to a hardness corresponding to 55 to 75 on the Shore Hardness Scale which provides sufficient rigidity to hold a football, as desired, while providing resiliency so not to hurt the kicker's foot when used.

The football kicking tee 20 is manufactured using techniques known in the art to form polymer articles. The method should be easy to fabricate kicking tee 20 so that it has a long useful life and can be used in varied climate conditions, such as heat, rain, snow, mud, and other types of conditions encountered during game conditions and practices.

As shown in FIGS. 1 and 6, first surface 28 is provided with directional indicia 42, such as a directional arrow. Indicia 42 will enable the kicker to line up kicking tee 20 in precise alignment with a goalpost or other target and remind the kicker to follow through with the kick. Indicia 42 also assist in aligning the football in the desired position as well. Kicking tee 20 can be aligned so that the kicker can point kicking tee 20 to the intended direction thus maximizing accuracy of the kicks.

It is contemplated that kicking tee 20 has a sufficient weight to increase stability and prevent kicking tee 20 from tipping over in use. Materials such as metal and the like can be added to kicking tee 20 to increase the weight so it can be used alone to hold a football in a substantially upright or angled position.

To use kicking tee 20, a user places kicking tee 20 on a "substrate", with preferably second surface 32 engaging the "substrate". The directional indicia 42 is used for proper orientation of kicking tee 20 to maximize the kick's accuracy. A kicker places one end of the football in opening 24 so the end of the football rests on the substrate while support member 22, shown as a ring in FIGS. 1–10, supports the football in a substantially vertical or angled position. The position of the football in opening 24 can be adjusted to various angles as desired. First frictionally enhanced finish 30 frictionally engage the football so it can be angled as desired by the kicker without use of another device or person. Then, a kicker kicks the football with either foot, in accordance with the user's kicking motion.

A straight-on kicker swings the leg toward the kicked ball with the ankle locked and the foot perpendicular to the leg so that the toe portion of the shoe engages the ball, usually at the top portion. In contrast, a soccer style kicker swings his leg to kick the ball with the ankle lock and the foot parallel to the leg so that the upper instep of the foot engages the football usually at the underside wall or bottom of the football.

The construction and configuration of kicking tee 20 is especially suited to provide the most accurate kick with the longest trajectory simulating game conditions by virtue of the tact that the kicker's instep or toe contacts only the underside wall of the football and does not engage any portion of kicking tee 20, be aligned so that the kicker can point tee 20 to the intended direction thus maximizing accuracy of the kicks.

Having shown and described the preferred embodiment of the present invention, it will be apparent that modifications and variations by one of ordinary skill in the art are possible without departing from the scope of the present invention to find in the appended claims. Several potential modifications have been mentioned and others will be apparent to those skilled in the art. For example, it should be understood that the kicking tee 20 can be molded as a one-piece device having ring 22 and extensions 38 so that the kicking tee 20 can be used as a kick-off tee as well as a device for practicing placekicking. According to the scope of the present invention should be considered in terms of the following claims and is understood not to be limited to the details of structure and operation shown and described in the specification in the drawing.

What I claim is:

1. A football kicking tee for supporting a football in a substantially upright or angled position on a substrate, comprising:

a support member having upper and lower surfaces with the lower surface being adapted to interface with a substrate, said surfaces confined between two spaced parallel planes, said support member further comprising inner and outer surfaces extending between the upper and lower surfaces;

at least a portion of said inner surface having a curved cross-sectional configuration and defining an opening extending between the first and second surfaces, the opening extending through the support member and being of sufficient size to allow the passage of an end portion of a football, but of insufficient size to allow passage of the entire football; said curved cross-sectional configuration of said inner surface providing a range of contact points for a football having an end portion extending into the opening, the elevation of the range of contact points on said curved cross-sectional configuration being variable depending on the angle at which the football is positioned.

2. The football kicking tee of claim 1, wherein said support member is a ring, said ring extends in a segment of a circle for a perimeter distance of approximately between 180 and 360 degrees.

3. The football tee of claim 2, wherein said ring extends in a segment of a circle for a perimeter distance of approximately between 270 and 320 degrees.

4. The football tee of claim 2 or 3, wherein said inner diameter of said ring is between about 2.05" and about 2.15".

5. The football tee of claim 1, wherein a portion of said inner surface is frictionally enhanced.

6. The football tee of claim 1, wherein said second surface is frictionally enhanced.

7. The football tee of claim 1, wherein said kicking tee further comprises extensions attached to said second surface to elevate said support member above the substrate.

8. The football tee of claim 7, wherein said extension are removable.

9. A football kicking tee for supporting a football in a substantially upright or angled position on a substrate, comprising:

a support member having upper and lower support services, the lower support surface being in contact with a substrate, said support surfaces confined between two spaced parallel planes, said support member further comprising inner and outer surfaces extending between the parallel planes;

said inner surface having a curved cross-sectional configuration and defining an opening extending from the upper surface to the substrate, the opening being of sufficient size to allow the passage of an end portion of a football, but of insufficient size to allow passage of the entire football; said opening being sized and configured to support a football in an upright or angled position while an end of a football remains in contact with the substrate when an end portion of the football is positioned in said opening.

10. The football kicking tee of claim 9, wherein said support member is a ring, said ring extends in a segment of a circle for a perimeter distance of approximately between 180 and 360 degrees.

11. The football tee of claim 10, wherein said ring extends in a segment of a circle for a perimeter distance of approximately between 270 and 320 degrees.

12. The football tee of claim 10 or 11, wherein said inner diameter of said ring is between about 2.05" and about 2.15".

13. The football tee of claim 9, wherein a portion of said inner surface is frictionally enhanced.

14. The football tee of claim 9, wherein said second surface is frictionally enhanced.

15. A football kicking tee for supporting a football in a substantially upright or angled position on a substrate, comprising:

a support member having upper and lower surfaces with the lower surface being adapted to interface with a substrate, said support member further comprising an inner surface extending between the upper and lower surfaces, at least a portion of said inner surface having a curved cross-sectional configuration and defining an opening extending between the first and second surfaces, the opening extending through the support member and being of sufficient size to allow the passage of an end portion of a football, but of insufficient size to allow passage of the entire football.

* * * * *